US008375493B2

(12) United States Patent
DeMoss et al.

(10) Patent No.: US 8,375,493 B2
(45) Date of Patent: Feb. 19, 2013

(54) ONE PIECE FOAM MATTRESS CORE ENCASEMENT

(75) Inventors: Larry K. DeMoss, Greensboro, NC (US); Julian T. Young, Zebulon, NC (US); Timothy M. Witherell, Gastonia, NC (US); Christopher D. Page, Nashville, NC (US)

(73) Assignee: Sealy Technology LLC, Trinity, NC (US)

( * ) Notice: Subject to any disclaimer, the term of this patent is extended or adjusted under 35 U.S.C. 154(b) by 55 days.

(21) Appl. No.: 13/167,061

(22) Filed: Jun. 23, 2011

(65) Prior Publication Data

US 2012/0047658 A1 Mar. 1, 2012

Related U.S. Application Data

(63) Continuation-in-part of application No. 12/870,316, filed on Aug. 27, 2010.

(60) Provisional application No. 61/435,876, filed on Jan. 25, 2011, provisional application No. 61/237,498, filed on Aug. 27, 2009.

(51) Int. Cl.
*A47C 27/05* (2006.01)
*A47C 27/14* (2006.01)

(52) U.S. Cl. ..... 5/739; 5/740; 5/737

(58) Field of Classification Search ..... 5/737, 739, 5/740, 716, 717
See application file for complete search history.

(56) References Cited

U.S. PATENT DOCUMENTS

| | | | |
|---|---|---|---|
| 554,580 | A | 2/1896 | Conkwright |
| 676,573 | A | 6/1901 | Bowers |
| 1,429,776 | A | 9/1922 | Robinson |
| 1,979,566 | A | 11/1934 | Morse |
| D105,428 | S | 7/1937 | Bahr |
| D136,717 | S | 11/1943 | Moore et al. |
| 2,337,525 | A | 12/1943 | Peik |
| 2,569,021 | A | 9/1951 | Rozanski |
| 2,615,577 | A | 10/1952 | Bartleman |
| 2,630,145 | A | 3/1953 | Stevens |
| 2,826,769 | A | 3/1958 | Drews |
| 2,940,089 | A | 6/1960 | Koenigsberg |
| 2,978,714 | A | 4/1961 | Bechik |

(Continued)

FOREIGN PATENT DOCUMENTS

| | | | |
|---|---|---|---|
| GB | 2095545 | A | 10/1982 |
| GB | 2154443 | A | 9/1985 |

(Continued)

OTHER PUBLICATIONS

Notice of Allowance for U.S. Appl. No. 12/455,968 mailed Jul. 23, 2012, 7 pages.

(Continued)

*Primary Examiner* — Michael Trettel
(74) *Attorney, Agent, or Firm* — James C. Scott; Roetzel & Andress

(57) ABSTRACT

A one piece foam mattress core or innerspring encasement is a single contiguous piece of foam having a mattress core or base and four perimeter side supports and which fits with a mattress core or innerspring to provide an integrated mattress construction. The mattress core or base of the encasement is positioned below the mattress core or innerspring proximate to or against a bottom surface. The mattress core or base and the perimeter side supports are connected along fold lines or grooves in the single piece of foam so that the perimeter side walls can be folded to vertical positions about a perimeter of the mattress core or innerspring. The single piece of foam of the encasement is producible in different sizes to fit with different size mattress cores or innersprings.

19 Claims, 8 Drawing Sheets

U.S. PATENT DOCUMENTS 3,046,574 A 7/1962 Erenberg et al.
3,263,533 A 8/1966 Carlson
3,293,671 A 12/1966 Griffin
3,318,224 A 5/1967 Bohanon
3,749,301 A 7/1973 Peckar
3,775,526 A 11/1973 Gilmore
3,822,426 A 7/1974 Mistarz
3,848,283 A 11/1974 Ikeda
3,894,706 A 7/1975 Mizusawa
D240,681 S 7/1976 Granatelli
D241,314 S 9/1976 Hug
D245,747 S 9/1977 Ikeda
4,121,005 A 10/1978 Roberts
4,181,992 A 1/1980 Blake
4,207,636 A 6/1980 Ceriani
4,275,473 A 6/1981 Poirier
D273,659 S 5/1984 Sakaguchi
4,451,946 A 6/1984 Stumpf
4,821,988 A 4/1989 Jimenez
4,907,309 A 3/1990 Breckle
4,915,662 A 4/1990 Kent
D307,688 S 5/1990 Schaefer
D307,690 S 5/1990 Raburn
D310,313 S 9/1990 Afeyan
4,998,310 A 3/1991 Olson
5,005,793 A 4/1991 Shillington
5,039,366 A 8/1991 Strattman
5,040,255 A 8/1991 Barber, Jr.
5,048,167 A 9/1991 Heffley et al.
D322,907 S 1/1992 Raburn
5,115,524 A 5/1992 Antosko
5,133,116 A 7/1992 Wagner et al.
5,195,197 A 3/1993 Gutierrez et al.
5,239,715 A 8/1993 Wagner
5,398,820 A 3/1995 Kiss
5,415,370 A 5/1995 Valiulis
D363,016 S 10/1995 Sipprelle, III et al.
5,456,437 A 10/1995 Chander et al.
5,462,212 A 10/1995 Hertel, Jr.
5,467,488 A 11/1995 Wagner
5,469,590 A 11/1995 Simon
5,491,852 A 2/1996 Maucher
5,537,699 A 7/1996 Bonaddio et al.
D376,309 S 12/1996 Takai
5,642,557 A 7/1997 Clews
5,687,439 A 11/1997 Wagner
5,705,252 A 1/1998 Lea et al.
5,724,686 A 3/1998 Neal
5,743,497 A 4/1998 Michael
5,756,022 A 5/1998 Siegel et al.
5,787,532 A 8/1998 Langer et al.
5,792,309 A 8/1998 Eto
5,815,865 A 10/1998 Washburn et al.
5,861,205 A 1/1999 Murata et al.
D406,051 S 2/1999 Ross
5,924,682 A 7/1999 Bullard
D413,035 S 8/1999 Weterrings et al.
5,987,678 A 11/1999 Ayers
D417,612 S 12/1999 Jones
6,003,179 A 12/1999 Farley
D418,354 S 1/2000 O'Rourke
6,023,803 A 2/2000 Barman
6,026,525 A 2/2000 Davis
6,109,569 A 8/2000 Sakaida
6,122,787 A 9/2000 Kao
D432,404 S 10/2000 Garfinkle
6,154,908 A 12/2000 Wells
D436,772 S 1/2001 Soderstrom
6,243,894 B1 6/2001 Kosumsuppamala et al.
6,260,331 B1 7/2001 Stumpf
6,263,533 B1 7/2001 Dimitry et al.
6,286,166 B1 9/2001 Henley et al.
6,295,676 B1 10/2001 Warner
6,306,235 B1 10/2001 Henderson
6,315,275 B1 11/2001 Zysman
D454,740 S 3/2002 Baggott
6,353,952 B1 3/2002 Wells
D456,197 S 4/2002 McClure et al.
6,370,717 B1 4/2002 Kao
6,398,199 B1 6/2002 Barber
D467,117 S 12/2002 Guy
6,488,031 B1 12/2002 Sells, II
6,496,993 B2 12/2002 Allen et al.
6,523,812 B1 2/2003 Spinks et al.
6,537,405 B1 3/2003 Henderson et al.
6,568,014 B1 5/2003 Sabalaskey et al.
6,574,814 B2 6/2003 Collard et al.
6,612,525 B2 9/2003 Bagdi
6,658,682 B1 12/2003 Wells
6,684,434 B2 2/2004 Ellis et al.
6,721,981 B1 4/2004 Greenhalgh et al.
6,772,463 B2 8/2004 Gladney et al.
6,813,791 B2 11/2004 Mossbeck et al.
6,826,796 B1 12/2004 Mossbeck
6,832,397 B2 12/2004 Gaboury et al.
6,862,763 B2 3/2005 Mossbeck et al.
6,883,196 B2 4/2005 Barber
6,898,813 B2 5/2005 Grothaus
D506,385 S 6/2005 Brown
6,954,957 B2 10/2005 Metzger et al.
6,966,090 B2 11/2005 McClintock et al.
6,966,091 B2 11/2005 Barber
7,017,205 B2 3/2006 Gladney
7,028,352 B2 4/2006 Kramer et al.
7,036,173 B2 5/2006 Gladney
7,044,557 B2 5/2006 Wieland
7,082,635 B2 8/2006 Barman et al.
7,093,858 B1 8/2006 Russell
7,127,765 B2 10/2006 Ruiz
7,165,282 B2 1/2007 Watson
D537,331 S 2/2007 Hill
7,178,187 B2 2/2007 Barman et al.
7,185,379 B2 3/2007 Barman
7,185,770 B1 3/2007 Roten
7,194,777 B2 3/2007 Edling et al.
7,210,181 B1 5/2007 Price
7,251,847 B2 8/2007 Wells
D569,160 S 5/2008 Mossbeck
D581,715 S 12/2008 Scheuch
D583,607 S 12/2008 Hanson et al.
7,546,648 B2 6/2009 Steffes
7,597,296 B2 10/2009 Conway
7,608,782 B2 10/2009 Hill
7,631,381 B2 * 12/2009 Flippin ..... 5/739
7,644,461 B2 1/2010 Lee
D612,188 S 3/2010 Yiannaki
7,685,664 B2 3/2010 Stolpmann et al.
7,805,790 B2 10/2010 DeMoss
7,841,031 B2 11/2010 Rawls-Meehan
7,845,035 B2 12/2010 Letton et al.
7,845,036 B2 12/2010 Rinchetti
7,865,988 B2 1/2011 Koughan et al.
D636,622 S 4/2011 Quinter et al.
D640,535 S 6/2011 Austro
D642,413 S 8/2011 Rinehart
D642,847 S 8/2011 Rinehart
7,992,712 B2 8/2011 Rosland
8,001,638 B1 8/2011 Quinter et al.
D648,211 S 11/2011 Weaver et al.
D653,895 S 2/2012 Reisenhus
D665,449 S 8/2012 Guirlinger
8,250,689 B2 8/2012 Gladney
2002/0069462 A1 6/2002 Gaboury et al.
2003/0074736 A1 4/2003 Grothaus
2003/0079284 A1 5/2003 Gaboury et al.
2003/0173814 A1 9/2003 Wieland et al.
2004/0128761 A1 7/2004 Gaboury et al.
2004/0128773 A1 7/2004 Barber
2004/0133988 A1 7/2004 Barber
2004/0182802 A1 9/2004 Paul
2004/0187217 A1 9/2004 Barman et al.
2004/0261186 A1 12/2004 Gladney
2005/0015884 A1 1/2005 Conaway et al.
2005/0028275 A1 2/2005 Hooper, Jr.
2005/0204475 A1 9/2005 Schmitz et al.
2005/0246839 A1 11/2005 Niswonger
2005/0251920 A1 11/2005 Ahn

| | | | |
|---|---|---|---|
| 2005/0262642 | A1 | 12/2005 | Miller |
| 2006/0031995 | A1 | 2/2006 | Barkhouse |
| 2006/0042016 | A1 | 3/2006 | Barman et al. |
| 2006/0260062 | A1 | 11/2006 | Barman et al. |
| 2007/0118987 | A1 | 5/2007 | Gladney et al. |
| 2008/0040861 | A1 | 2/2008 | Ootayopas |
| 2008/0115288 | A1 | 5/2008 | Poulos |
| 2009/0000030 | A1 | 1/2009 | Hicks et al. |
| 2009/0011203 | A1 | 1/2009 | Mock et al. |
| 2009/0013476 | A1 | 1/2009 | Rinchetti |
| 2009/0025150 | A1 | 1/2009 | Smalling et al. |
| 2009/0031502 | A1 | 2/2009 | Berrcocal et al. |
| 2009/0100606 | A1 | 4/2009 | An |
| 2009/0106894 | A1 | 4/2009 | Yeo |
| 2009/0139033 | A1 | 6/2009 | Gladney |
| 2009/0294623 | A1 | 12/2009 | Pinchuk |
| 2010/0071136 | A1 | 3/2010 | Weber |
| 2010/0077552 | A1 | 4/2010 | Malikhin et al. |
| 2010/0319137 | A1 | 12/2010 | Witherell et al. |
| 2010/0325806 | A1 | 12/2010 | Letton et al. |
| 2011/0049327 | A1 | 3/2011 | Young et al. |
| 2011/0179579 | A1 | 7/2011 | Henderson et al. |
| 2011/0197368 | A1 | 8/2011 | Tarazona De La Asuncion |
| 2012/0167312 | A1 | 7/2012 | Sobran et al. |
| 2012/0180224 | A1 | 7/2012 | DeMoss et al. |
| 2012/0284928 | A1 | 11/2012 | Henderson et al. |

FOREIGN PATENT DOCUMENTS

| | | | |
|---|---|---|---|
| WO | 2009014657 | A1 | 1/2009 |
| WO | 2010117352 | A1 | 10/2010 |

OTHER PUBLICATIONS

Non-final Office Action for U.S. Appl. No. 29/398,647 mailed May 8, 2012, 6 pages.

Non-final Office Action for U.S. Appl. No. 13/418,649 mailed May 15, 2012, 15 pages.

Non-final Office Action for U.S. Appl. No. 12/870,316 mailed Aug. 21, 2012, 12 pages.

Notice of Allowance for U.S. Appl. No. 29/398,649 mailed Aug. 29, 2012, 6 pages.

Notice of Allowance for U.S. Appl. No. 29/398,647 mailed Aug. 30, 2012, 6 pages.

"Expandable Grids Made of ETHOFOAM Brand Polyethylene Foam," ETHAFOAM, Dec. 1997, 7 pages.

Final Office Action mailed Nov. 8, 2010 for U.S. Appl. No. 12/455,968, 13 pages.

Non-final Office Action mailed May 26, 2010 for U.S. Appl. No. 12/455,968, 13 pages.

Non-final Office Action mailed Oct. 12, 2011 for U.S. Appl. No. 12/455,968, 12 pages.

Notice of Allowance mailed Dec. 31, 2009 for U.S. Appl. No. 29/342,503, 4 pages.

Non-final Office Action mailed Sep. 13, 2011 for U.S. Appl. No. 12/386,584, 18 pages.

Notice of Allowance mailed May 9, 2012, for U.S. Appl. No. 29/398,649, 8 pages.

Non-final Office Action for U.S. Appl. No. 12/386,584 mailed Feb. 3, 2012, 17 pages.

Quayle Action for U.S. Appl. No. 29/361,180 mailed Sep. 13, 2012, 11 pages.

Notice of Allowance for U.S. Appl. No. 29/361,180 mailed Nov. 27, 2012, 6 pages.

Notice of Allowance for U.S. Appl. No. 29/403,050 mailed Sep. 28, 2012, 8 pages.

* cited by examiner

ONE PIECE FOAM MATTRESS CORE ENCASEMENT

RELATED APPLICATIONS

This application is a continuation-in-part of U.S. application Ser. No. 12/870,316, filed Aug. 27, 2010, entitled ASSEMBLIES, SYSTEMS, AND RELATED METHODS EMPLOYING INTERLOCKING COMPONENTS TO PROVIDE AT LEAST A PORTION OF AN ENCASEMENT, PARTICULARLY FOR BEDDING AND SEATING APPLICATIONS, a provisional conversion of U.S. provisional application No. 61/435,876, filed Jan. 25, 2011, entitled ONE PIECE MATTRESS CORE FOAM ENCASEMENT, a conversion of U.S. provisional application No. 61/237,498, filed Aug. 27, 2009, entitled ENCASEMENT ASSEMBLIES, SYSTEMS, AND RELATED METHODS EMPLOYING FLIP-UP SUPPORT MEMBER(S), PARTICULARLY FOR BEDDING AND SEATING APPLICATIONS.

FIELD OF THE INVENTION

The present invention is directed to mattresses and mattress innersprings and more specifically to mattresses which include both wire form innersprings and structural foam components.

BACKGROUND OF THE INVENTION

Foam components are commonly combined with wire or steel form innersprings in mattresses, seating and other flexible support structures. Early versions included foam layers which were either attached directly to a wire innerspring or simply held in position by overlying upholstery. Smaller foam components are designed to fit within spaced of the innerspring.

Different types of foam and foam parts have been used extensively in seating and bedding as flexible support material. Semi-rigid open and closed cell foams of polyethylene, polyurethane or polystyrene have been used in combination with other components and load-bearing structures, such as wire form innersprings and framing to form flexible supports, such as described in U.S. Pat. Nos. 5,048,167; 5,469,590; 5,467,488; 5,537,699; and 5,787,532. In most of these spring support products, the foam pieces surround or interfit with spring elements, and rely on mechanical connection with the spring elements to keep the foam pieces in place. Foam pieces have been adhesively bonded and combined with innersprings. The types of foams used in these applications are typically open-cell polyurethane and latex materials, which can be effectively bonded by compatible adhesives. The open cell structure of these types of foams results in easier compression or lower ILD which is suitable for many bedding and seating applications, particularly for support surface or topper layers underneath upholstery. They are not generally utilized as structural members in a mattress or support cushion in seating. Also, polyurethane and other non-thermoplastic type foams cannot be bonded or welded by any heat-source process due to their decomposition properties.

Some foam shapes have been used integrally with springs to augment or otherwise support metal spring structure, as shown for example in U.S. Pat. Nos. 5,133,116; 5,239,715, 5,467,488; and 5,687,439. Because this use of foam relies on the surrounding metal structure to hold it in place, the foam itself is not in the form of a unitized three-dimensional support structure with its own load bearing capacity.

Another use of foam in connection with an innerspring is disclosed in U.S. Pat. No. 5,787,532, wherein an extruded foam piece is used as a perimeter wall to an innerspring, with fingers which mechanically engage the coils of the innerspring. While this provides some vertical support at the perimeter of the innerspring, it relies on mechanical attachment to the innerspring for the correct orientation. It also only provides support in the vertical direction and does nothing to stabilize the innerspring in the lateral or horizontal direction.

SUMMARY OF THE INVENTION

As described herein, the present disclosure and related inventions describe a mattress innerspring in combination with a mattress core foam encasement having an base located beneath the mattress innerspring, and four perimeter supports which are located about a perimeter of the mattress innerspring. In a preferred embodiment, the base and the four perimeter supports are formed from a single contiguous piece of foam.

In another aspect of the invention, a one piece mattress core foam encasement is described having a substantially rectangular base having a right side, a left side opposite and parallel to the right side, a top side and a bottom side opposite and parallel to the top side, the top and bottom sides being perpendicular to the left and right sides, a right perimeter support connected to the right side of the base along a fold line, a left perimeter support connected to the left side of the base along a fold line, a top perimeter support connected to the top side of the base along a fold line, and a bottom perimeter support connected to the bottom side of the base along a fold line. The base is placed below a mattress innerspring and the right, left, top and bottom perimeter supports are folded in an upward direction such that they are perpendicular to the base and so that the mattress innerspring is surrounded along four sides and a bottom surface by the innerspring support.

DETAILED DESCRIPTION OF PREFERRED AND ALTERNATE EMBODIMENTS

Figure 1:
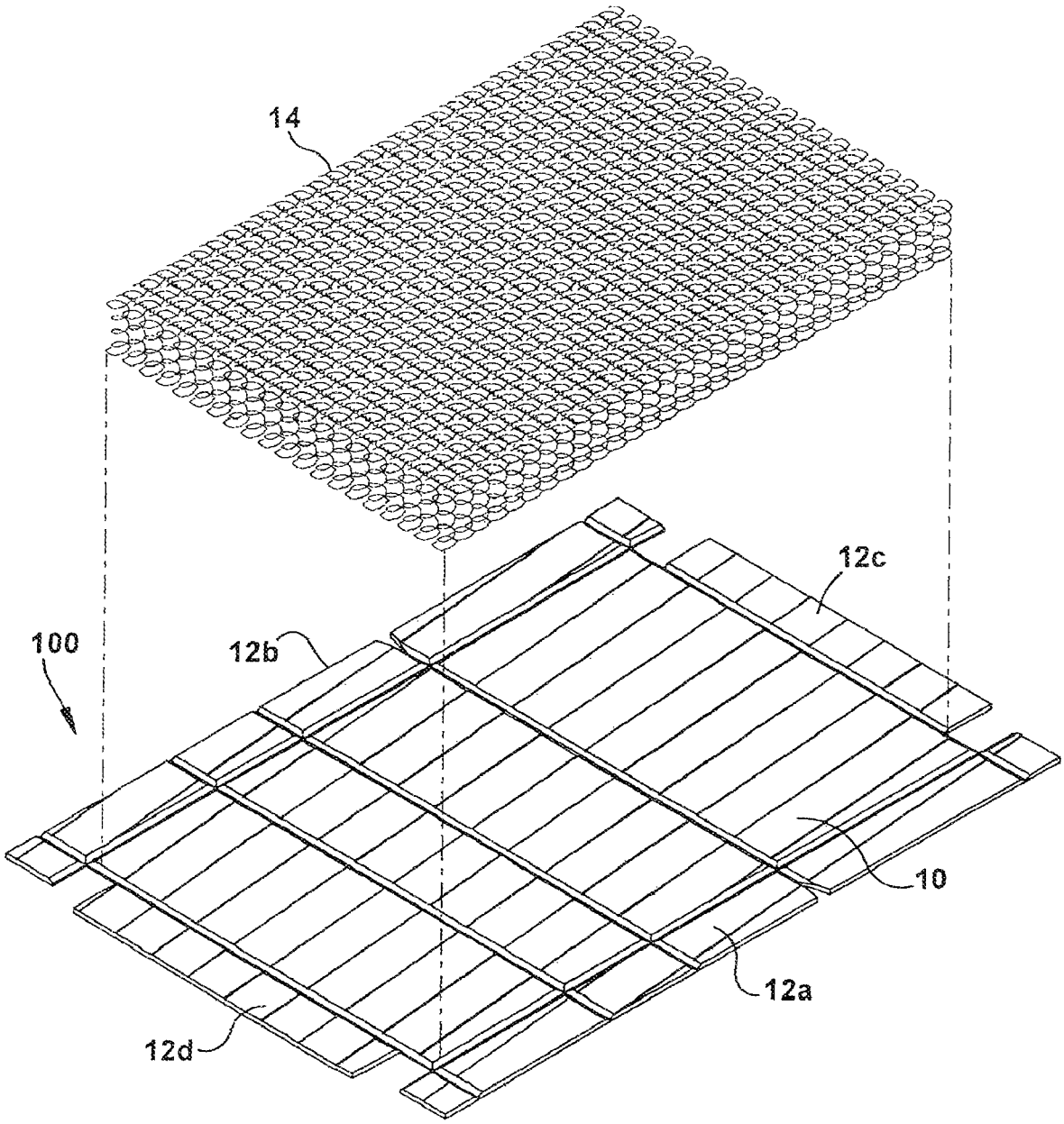
FIG. 1 is a perspective view of the one piece mattress core foam encasement and innerspring of the present invention.

The one-piece foam mattress core encasement 100, as shown in the drawing figures and described herein, is a single piece of foam having a plurality of grooves or cuts that forms a foam encasement about a mattress core, which may be in the form of an innerspring, a block or layers of foam, or fabric-covered or "pocketed" springs, or any combination thereof, all referred to herein as "mattress core". In a preferred embodiment, a foam mattress core encasement 100 of the present disclosure has a base section which underlies and supports a mattress core, and one or more side walls or "side supports" which extend perpendicularly from the base section in an assembled configuration to provide a perimeter wall that surrounds the outer perimeter of the innerspring.

As shown in FIG. 1, the foam mattress core encasement 100 of the present invention is one contiguous piece of foam that serves as both an base and a perimeter wall support for the mattress innerspring 14. The single piece foam mattress core encasement 100 provides underlying foam support for the mattress core, foam padding and protection for the perimeter of the mattress core, and vertical support at the perimeter of the finished mattress. All of these advantages are achieved without having to assemble multiple foam pieces to form a three-dimensional structure which fits and cooperates with a mattress core.

As shown in FIGS. 1-4, one embodiment of a foam mattress core encasement 100 has a base 10 and four perimeter supports 12*a*, 12*b*, 12*c*, 12*d*. The base 10 is preferably a rectangular piece of foam having a right side, a left side which is parallel to and opposite the right side, a top side and a bottom side which is parallel to and opposite the top side. The foam material may be in the form of a sheet or slab of generally homogeneous foam, such as polyurethane foam, which may be molded or extruded in the described configurations or fused or adhered together from separate pieces, as further described. The perimeter support includes a right perimeter support 12*a*, a left perimeter support 12*b*, a top perimeter support 12*c* and a bottom perimeter support 12*d*, which are each elongate foam strips which are connected to each of the four sides of the rectangular base 10. The perimeter supports 12*a*-12*d* are preferably flexibly connected to the base 10 along a flexible line of connection which is preferably the same foam material as the base and perimeter supports. For example, the thickness of the foam material may be reduced along the lines of intersection of the perimeter supports 12*a*-12*d* with the base 10 whereby the perimeter supports 12*a*-12*d* can be folded relative to the base 10 to the perpendicular configuration shown in FIG. 4. The lines of intersection between the perimeter supports 12*a*-12*d* and the base 10 may be of any desired thickness and width, and may be contoured or mitered to form a tight joint between the pieces when the perimeter supports 12*a*-12*d* are folded relative to the base 10 in the perpendicular configuration shown in FIG. 4. One preferred configuration of the intersections is in the form of generally V-shaped grooves 16 formed by mating 45 degree contours in the facing edges of the perimeter supports 12*a*-12*d* and the base 10.

Figures 2, 3:
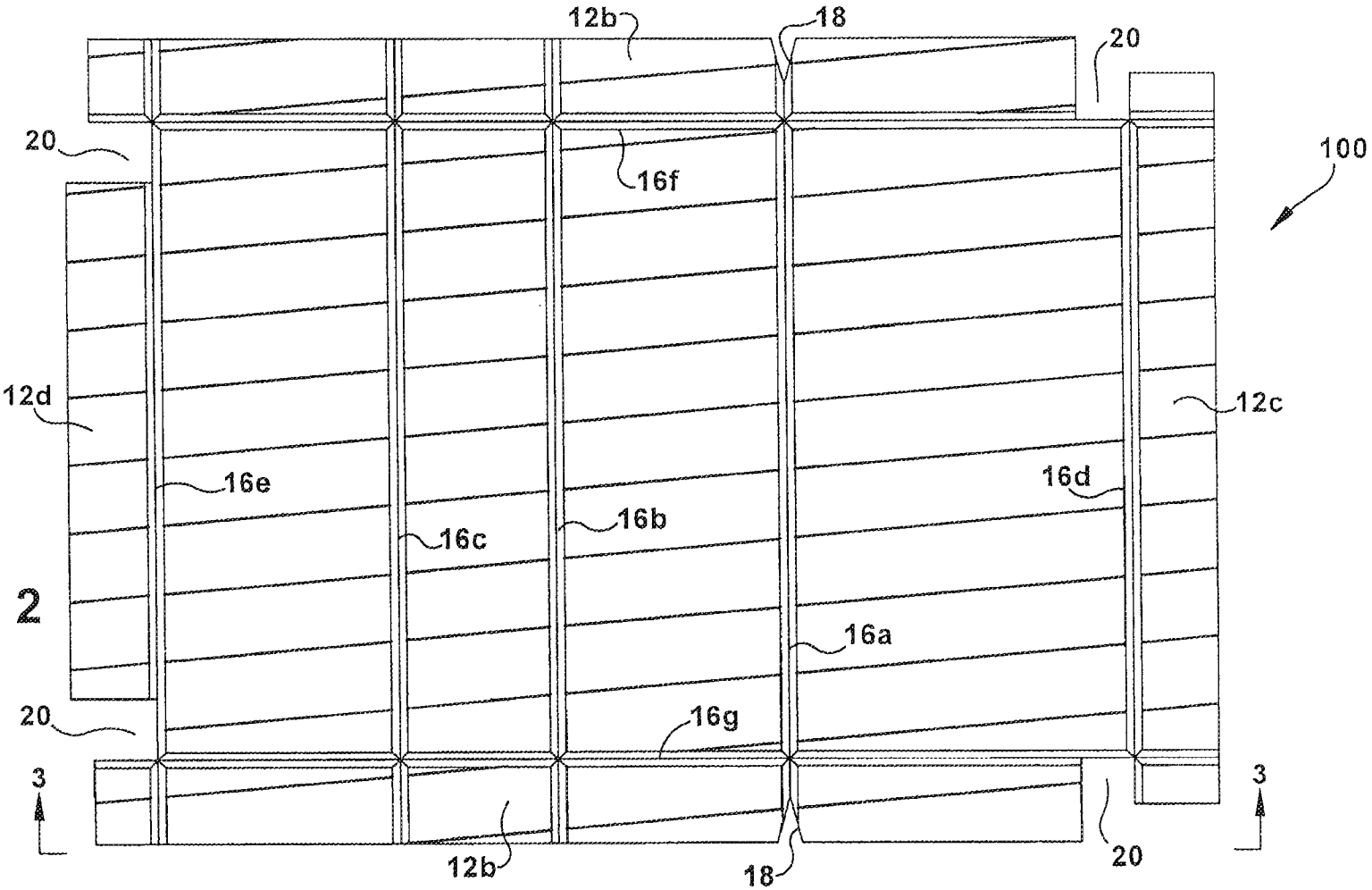
FIG. 2 is a top up view of the one piece mattress core foam encasement.
FIG. 3 is a side view of the one piece mattress core foam encasement of FIG. 2 in the direction of arrows 3-3.
Figure 6:
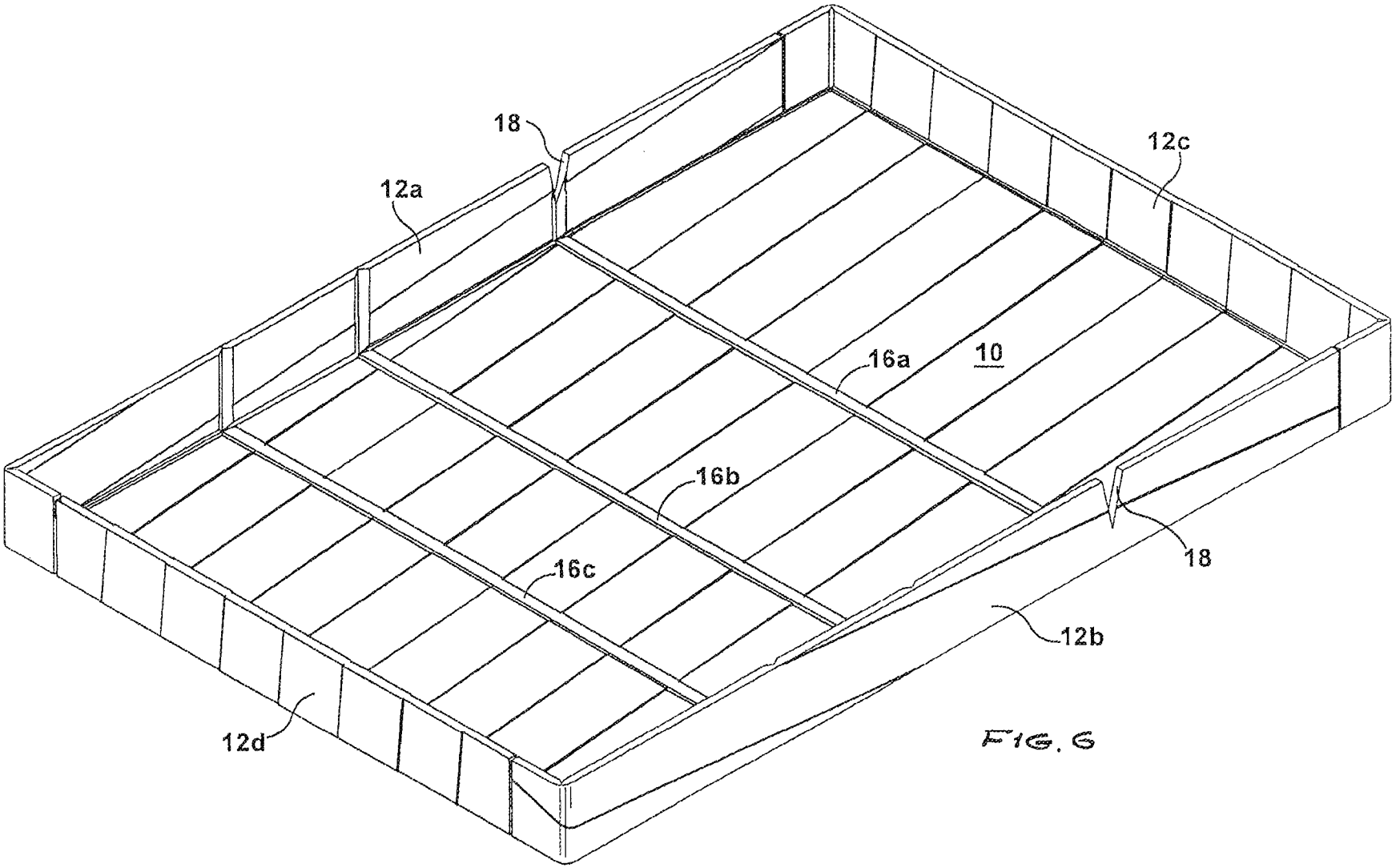
FIG. 6 is a perspective view of the one piece mattress core foam encasement without the innerspring.

In another embodiment, the base 10 contains several folds or V-shaped grooves 16 run transverse across the width of the base 10 from the right side to the left side. The right and left perimeter supports 12*a*, 12*b* which run along the right and left sides of the base 10 each also contain a plurality of folds or grooves, which align with the plurality of folds or grooves of the base. The folds or v-shaped grooves 16*a*-16*c* that connect the perimeter supports 12*a*-12*d* to the base 10 facilitate folding the perimeter supports 12*a*-12*d* upward so that each perimeter support 12*a*-12*d* is in an upright position perpendicular to the innerspring or core base 10. These v-shaped grooves 16*a*-16*c* create a 120 degree angle between the core base 10 and each perimeter support 12*a*-12*d*. The other folds or V-shaped grooves 16*a*-16*c* which run across the width of the foundation and right and left perimeter supports 12*a*, 12*b* facilitate bending or other such movement when used in combination with mattress cores of different sizes or mattress cores for use with adjustable foundations, and are strategically placed to accommodate the bending or movement of an articulated mattress. A V-shaped notch or cutout 18 exists at each end of the groove positioned proximate to the head 12*c* of the base 10, as shown in FIGS. 3 and 6. The notch 18 allows the innerspring or core base 10 to bend on itself without deforming. A first groove 16*a* is positioned horizontally across the support approximately between 24 and 28 inches from the head of the base 10 or from the groove 16*d* that separates the top perimeter support 12*c* and the innerspring or core base 10. A second groove 16*b* is positioned between 18.25 and 18.75 inches from the first groove 16*a*. A third groove 16*c* is positioned approximately 12.50 and 13.00 inches from the second groove 16*b* and approximately between 17 and 20 inches from the bottom of the support or the groove 16*e* that separates the bottom perimeter support 12*d* and the base 10.

Figure 4:
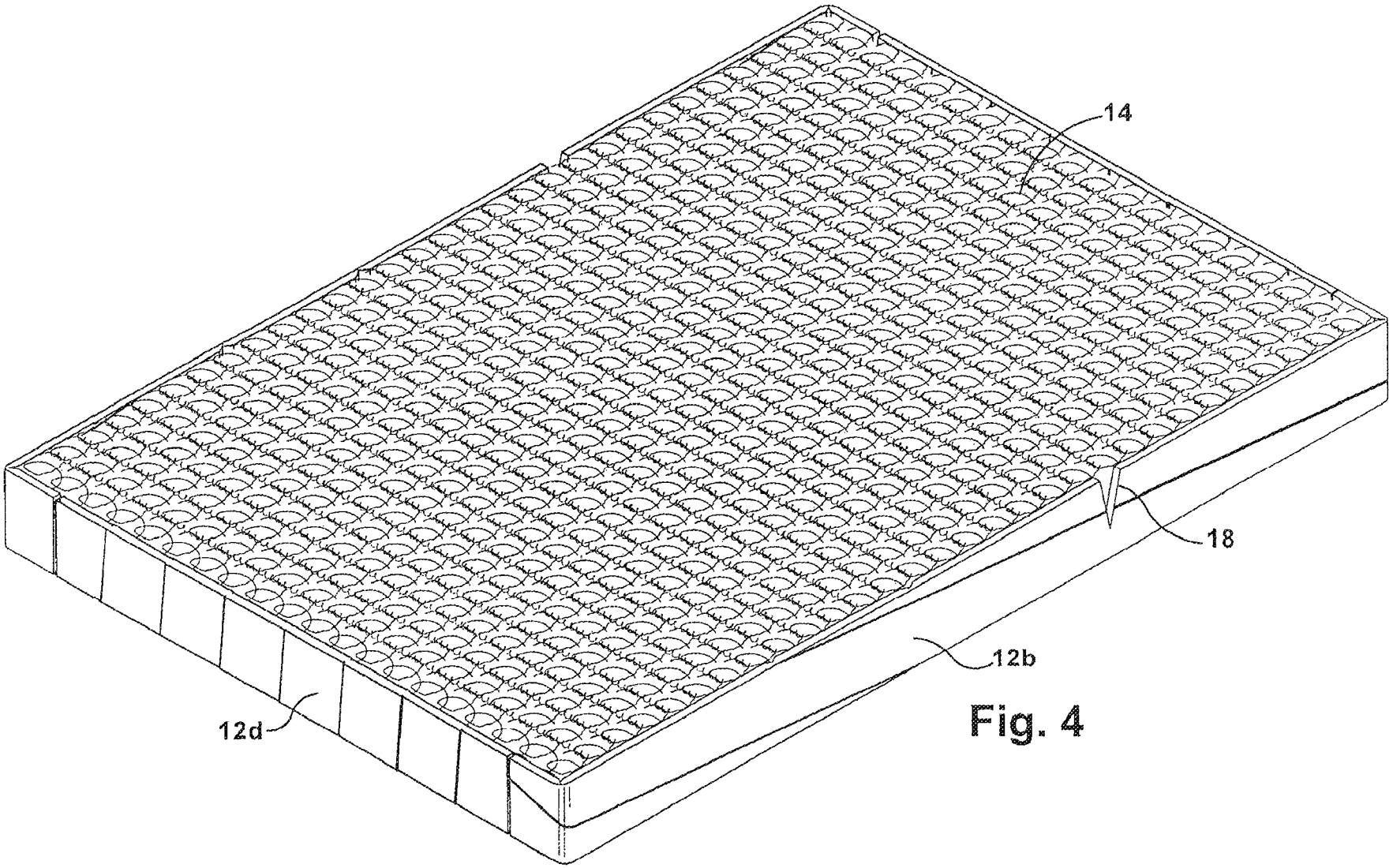
FIG. 4 is a perspective view of an innerspring encased in the one piece mattress core foam encasement.

In one embodiment, the length of the top and bottom perimeter supports 12*c*, 12*d* is less than the length of the top and bottom perimeter of the mattress innerspring 14 and the length of the right and left perimeter supports 12*a*, 12*b* is greater than the length of the right and left perimeter of the mattress innerspring 14. This configuration provides for four cutout sections 20 that are strategically placed proximate to each corner of the perimeter supports along the top and bottom perimeter supports 12*c*, 12*d*, as shown in FIG. 1. The cutouts 20 enable the support to be folded upward to encase the perimeter of the innerspring 14 without any extraneous material. In a preferred embodiment, the cutouts 20 range in size from 5.0 to 5.5 inches. As shown in FIGS. 4 and 5, as the four perimeter supports 12*a*-12*d* are folded upward into an upright position which is perpendicular to the base 10, the extra length at the top and bottom of the right and left perimeter supports 12*a*, 12*b* fold along the fold line or groove 16*d*, 16*e* so that they are perpendicular to the right and left perimeter supports 12*a*, 12*b*. This extra length fills in the space along the top and bottom perimeter such that each of the right, left, top and bottom perimeter supports 12*a*-12*d* completely cover the entire perimeter of the mattress innerspring 14. In an alternate embodiment, the length of the right and left perimeter supports 12*a*, 12*b* is less than the length of the right and left perimeter of the mattress innerspring 14 and the top and bottom perimeter supports 12*c*, 12*d* is greater than the length of the top and bottom perimeter of the mattress innerspring 14. Here, the four cutouts 20 are located along the right and left perimeter supports 12*c*, 12*d*. In another embodiment, shown in FIG. 2, two cutouts may be contained along the bottom perimeter support 12*d*, one cutout is located along the right perimeter support 12*a* and one cutout is located along the left perimeter support 12*b*. Any two sides of the perimeter support may be longer than the corresponding mattress perimeter while the other two sides are shorter than the corresponding mattress perimeter so that the entire perimeter may be folded upward and the longer sides can be folded perpendicularly to fill the gap on an adjacent shorter side.

The height of each of the four perimeter supports 12*a*-12*d* is substantially equal to the height of the mattress innerspring 14. In a preferred embodiment, the height perimeter support is approximately between 6.5 and 7.0 inches.

The perimeter support 10 is attached to the innerspring in a preferred embodiment, by fastening the edges of the perimeter support to every other innerspring coil with a hog or C-ring. Once each of the perimeter supports 12*a*-12*d* is folded upward so that the perimeter supports 12*a*-12*d* are perpendicular in relation to the innerspring or core base 10 and they surround the perimeter of the mattress innerspring 14, the mattress innerspring 14 is encased within the one piece mattress core foam encasement 100 much like an inverted box top, as shown in FIG. 4. The one piece support provides both vertical and horizontal support.

Figure 5A:
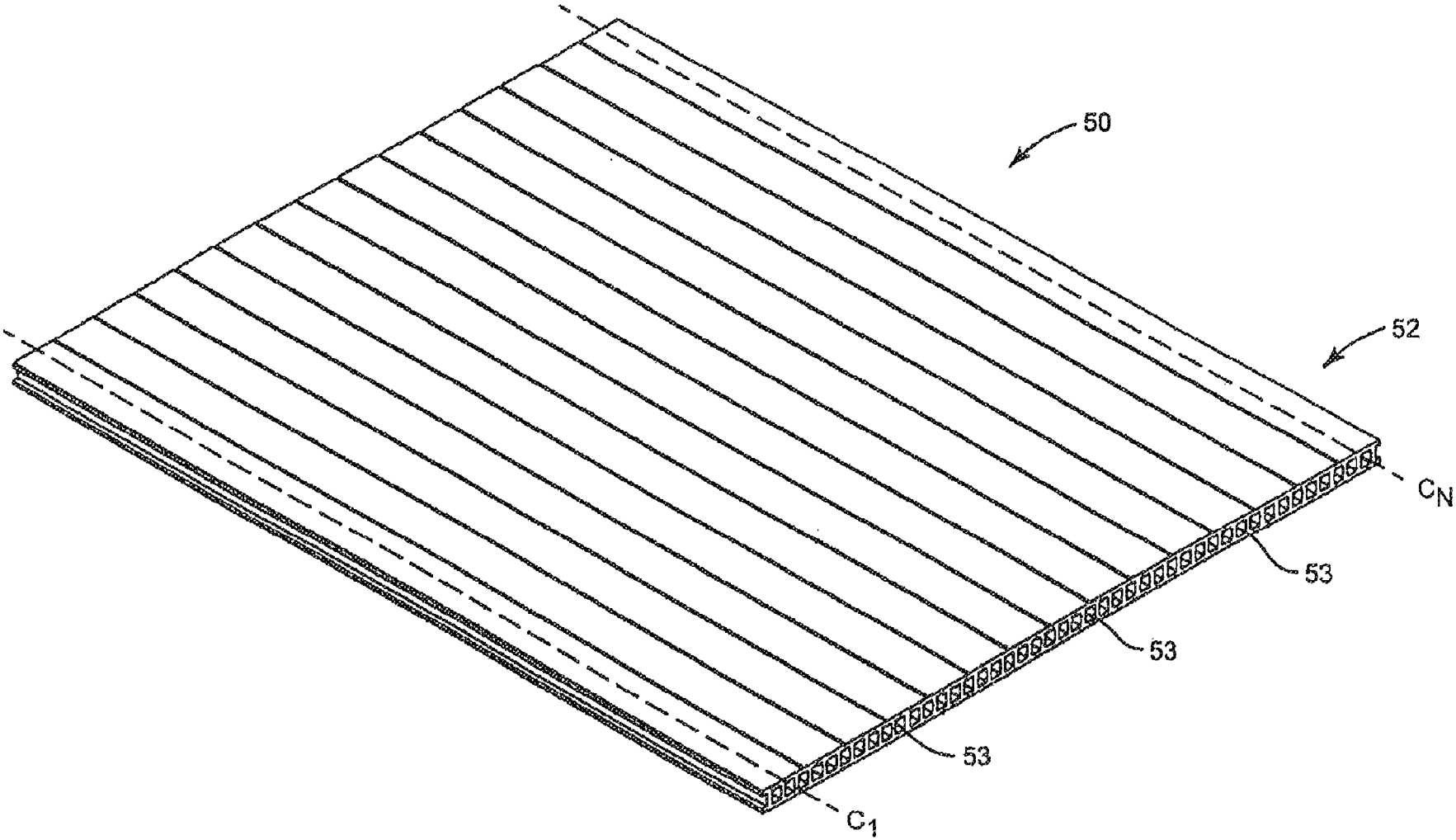
FIG. 5A is an exemplary foam base for an encasement.

FIGS. 5A-5D illustrate another embodiment of an encasement that may be provided. In this embodiment as illustrated in FIG. 5A, an encasement 50 is provided that is comprised of a base 52. In this embodiment, the encasement 50 is constructed from a one-piece base 52 as opposed to additional or separate pieces being required to provide an assembled encasement. The base 52 may be manufactured from extruded polymer foam. As examples of the wide variety of alternate compositions that can be employed and effectively used, the base 52 may be formed from one or more materials selected from the group consisting of polystyrenes, polyefins, polyethylenes, polybutanes, polybutylenes, polyurethanes, polyesters, ethylene acrylic copolymers, ethylene-vinyl-acetate copolymers, ethylene-methyl acrylate copolymers, ethylene-butyl-acrylate copolymers, ionomers, polypropylenes, copolymers of polypropylene, and the like. Such polymers may be foamed to provide the base 52 including either open-cell foam, closed-cell foam, or both open and closed-cell foam. An example of an extruded polymer base and method of manufacture of same are disclosed in U.S. Pat. Nos. 6,537,405 entitled "Spiral Formed Products and Method of Manufacture," and 6,306,235 entitled "Spiral Formed Products and Method of Manufacture," both of which are incorporated herein by reference in their entireties. The density of the base 52 may be any density desired.

Figure 5B:
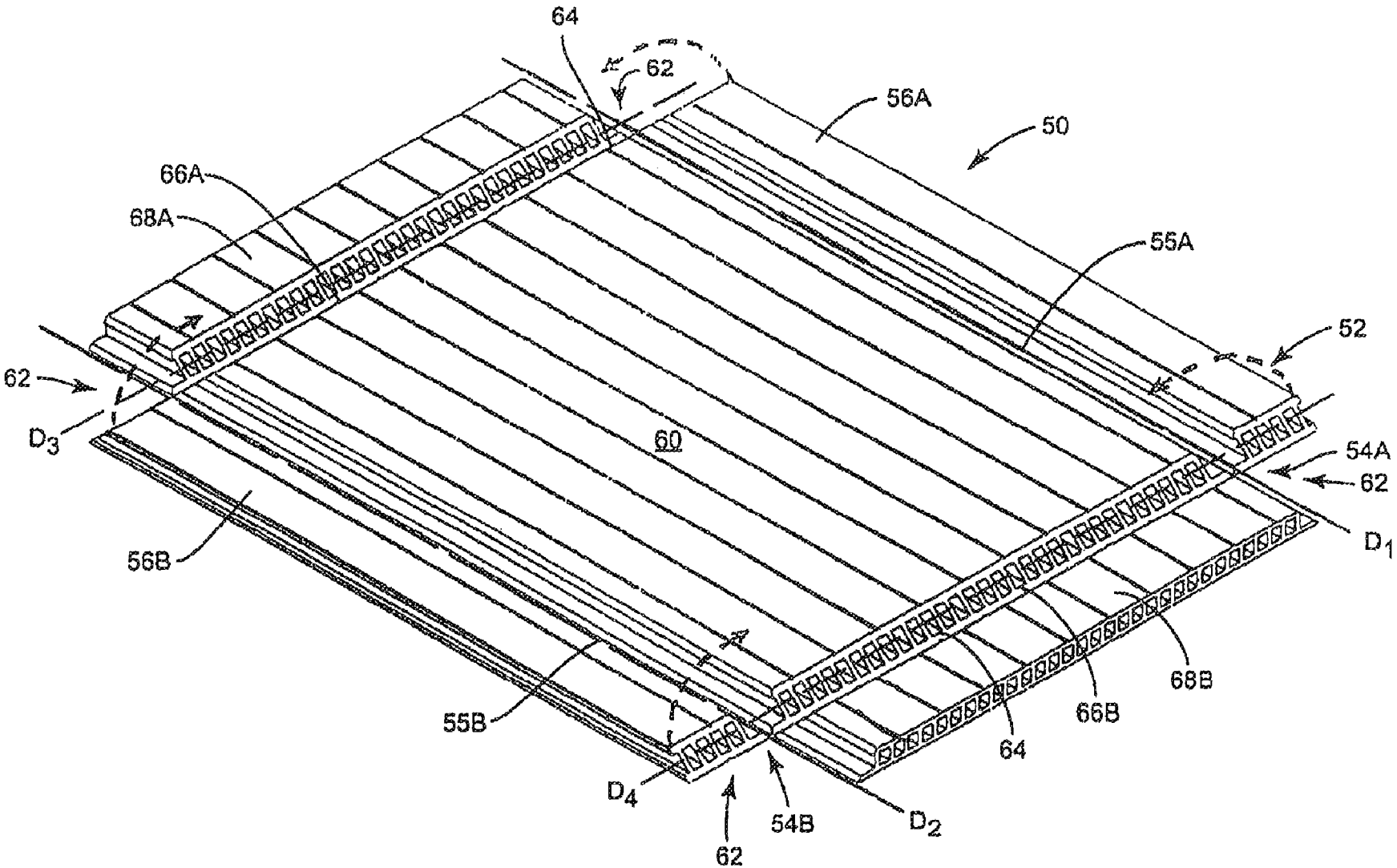
FIG. 5B is the base of FIG. 5A with contour cuts and corners removed to create living hinges alongside axes of the base to create flip-up side-support members disposed around the perimeter of the base.
Figure 5C:
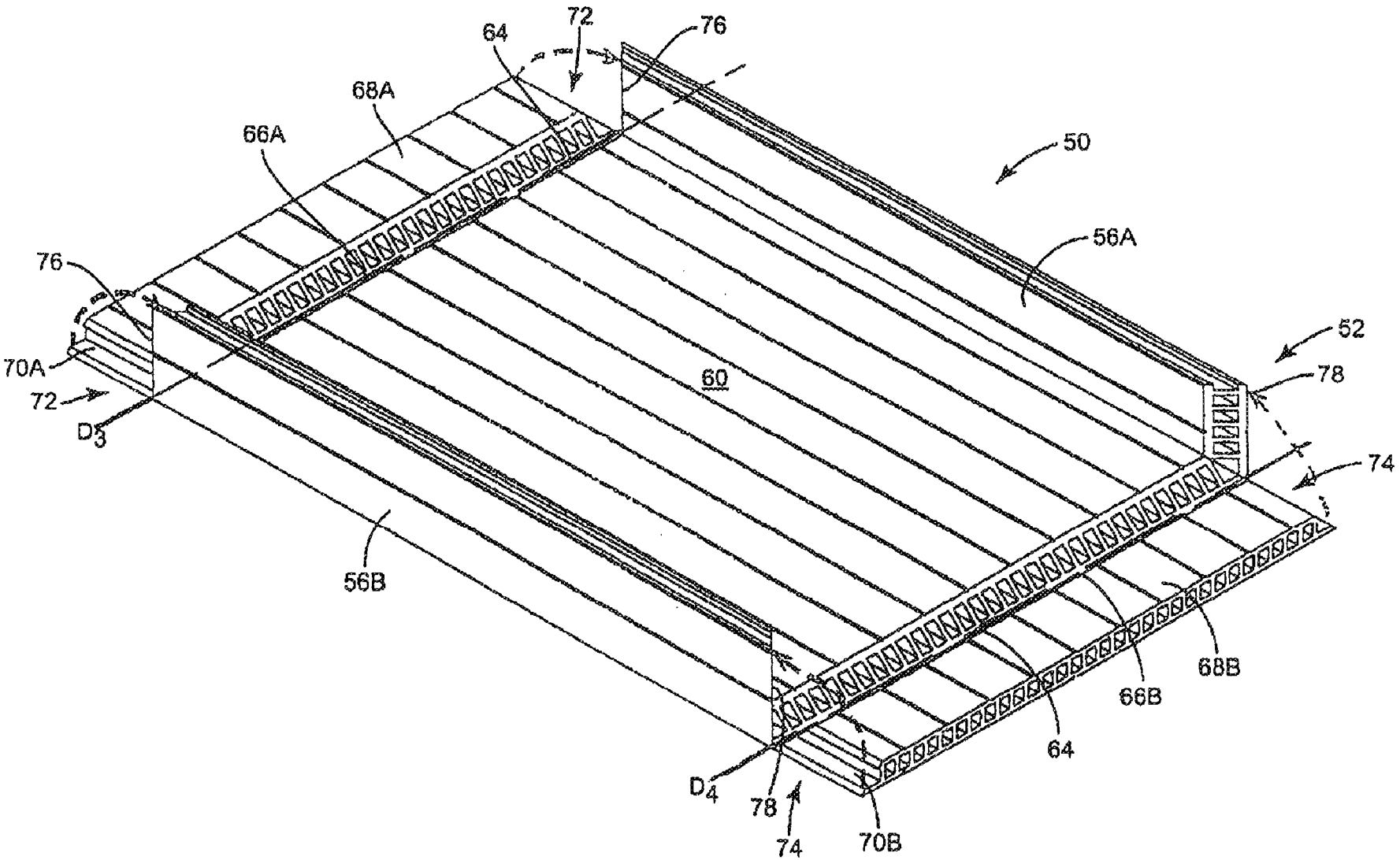
FIG. 5C is the base of FIG. 5B with flip-up side-support members disposed on sides of the base flipped-up or set about the base to create side support.
Figure 5D:
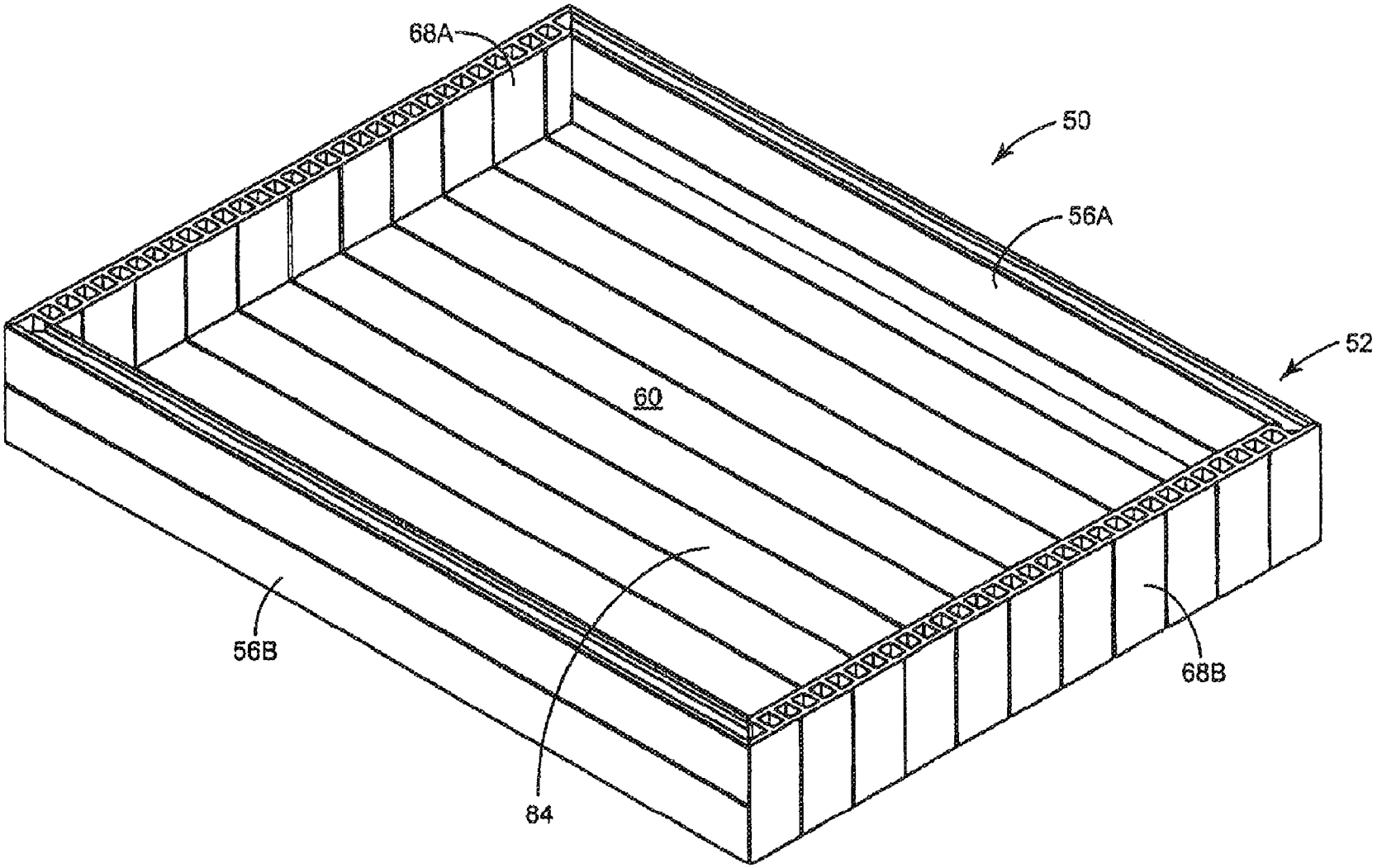
FIG. 5D is an assembled one-piece encasement formed by the flip-up side-support members disposed on the head end and foot end of the base additionally flipped-up or set about the base and attached on ends to the flipped-up or set side-support members in FIG. 5C to provide perimeter support around an internal area within the encasement.

The base 52 may optionally include one or more extruded channels 53 disposed along longitudinal axes $C_1$-$C_N$ to reduce material and thus reduce costs and/or to provide spring-like action in the base 52. FIGS. 5B-5D illustrate how the encasement 50 is provided from the base 52 in FIG. 5A in this embodiment. As illustrated in FIG. 5B, two sets of contour cuts 54A, 54B are disposed along longitudinal axes $D_1$, $D_2$ in the base 52 to provide living hinges 55A, 55B. In this manner, flip-up side-support members 56A, 56B are formed about the living hinges 55A, 55B. The flip-up side-support members 56A, 56B can be rotated approximately ninety degrees (90°) towards an internal area 60 of the base 52 to provide two sides of perimeter support as part of constructing the encasement 50.

In this embodiment, corners 62 are cut out from the base 52. Turning back to FIG. 5B, the corners 62 are cut out and contour cuts 64 are also disposed along axes $D_3$, $D_4$ in the base 52. These contour cuts 64 provide living hinges 66A, 66B in the base 52 to create additional flip-up side-support members 68A, 68B. In this manner, the flip-up side-support members 68A, 68B can also be flipped up or set about the base 52 to provide an enclosed encasement 50, as illustrated in FIGS. 5C and 5D. Additional contour cuts 70A, 70B, are disposed in each of the flip-up side-support members 68A, 68B so that ends 72, 74 of the flip-up side-support members 68A, 68B can abut end portions 76, 78 of the flip-up side-support members 56A, 56B to provide an assembled encasement 50, as illustrated in FIG. 5D. The contour cuts 64, 70A, 70B can be made for example at forty-five degrees across a section of the respective support member to form a mitered cut for a ninety degree joint between the support members and/or with the base 52. The flip-up side-support members 56A, 56B, 68A, 68B can be interlocked together according to any of the methods previously described to form an internal area 84 in the encasement 50, as illustrated in FIG. 5D, to provide perimeter support, including edge or side support. Any of the aforementioned surface support structures can be disposed in the internal area 84 to provide an assembly, which may be for a mattress or other bedding or cushioning application.

In a preferred embodiment, the foam used for the combined foundation and perimeter support is low density polyethylene and is approximately ⅝ inches, although it is anticipated that other types of foam with varying thickness measurements may be used. The low density polyethylene foam has a density of approximately 1.12 lb/ft$^3$. The base piece is placed below the mattress innerspring and covers the entire bottom surface of the innerspring. The size of the support will vary depending on the size of the mattress (e.g. king, queen, twin, etc.). The support may range from 50 to 86 inches wide and from 87 to 97 inches in length. The weight of the support may range from 1.50 to 3.5 lbs.

Prior to placing the mattress atop the innerspring which is encased within the one-piece foundation and perimeter support, a layer of non-woven fabric may be placed directly on top of the innerspring. The layer of non-woven fabric serves as an insulator and also prevents the coils from damaging the foam layers of the mattress assembly. In a preferred embodiment, the non-woven fabric layer is spunbond polypropylene, although other materials can be used.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A mattress core in combination with a foam encasement, the mattress core foam encasement comprising:

a base located beneath the mattress core;

four perimeter supports which are in direct contact with a perimeter of the mattress core;

wherein the base and the four perimeter supports are part of a single contiguous piece of foam, the perimeter supports being folded relative to the base to extend perpendicularly from the base and substantially surround a perimeter of the mattress core.

2. The mattress core foam encasement combination of claim 1, wherein the mattress core foam encasement is made of polyethylene.

3. The mattress core foam encasement combination of claim 1, wherein the base of the foam encasement has a plurality of v-shaped grooves.

4. The mattress core foam encasement combination of claim 1, wherein the foam encasement further comprises a generally V-shaped groove between the base and each of the four perimeter supports.

5. The mattress core form encasement combination of claim 1, wherein the mattress core is in direct contact with the base.

6. The mattress core foam encasement combination of claim 1, wherein the density of the foam encasement is in a range of approximately 1.0 to 1.5 lb/ft$^3$.

7. The mattress core foam encasement combination of claim 1, wherein the foam encasement has a total weight in an approximate range of 1.75 lbs, to 3.27 lbs.

8. The mattress core foam encasement combination of claim 1, wherein a width dimension of the foam encasement is in an approximate range of 50 inches to 86 inches.

9. The mattress core foam encasement combination of claim 1, wherein a length dimension of the foam encasement is in an approximate range of 87 inches to 97 inches.

10. The mattress core foam encasement combination of claim 1, wherein a height dimension of the four perimeter supports when oriented perpendicular to the base is in a range of approximately 6.5 inches to 7.5 inches.

11. A one piece mattress core foam encasement comprising:

a substantially rectangular base having a right side, a left side opposite and parallel to the right side, a top side and a bottom side opposite and parallel to the top side, the top and bottom sides being perpendicular to the left and right sides;

a right perimeter support connected to the right side of the base along a fold line;

a left perimeter support connected to the left side of the base along a fold line;

a top perimeter support connected to the top side of the base along a fold line;

a bottom perimeter support connected to the bottom side of the base along a fold line;

wherein the base is placed below a mattress core and the right, left, top and bottom perimeter supports of the foam encasement are folded relative to the base and positioned generally perpendicular to the base and about a perimeter of the mattress core, and wherein the base and the mattress core have substantially the same length and width measurements.

12. The one piece mattress core foam encasement of claim 11, wherein the mattress core foam encasement is made of polyethylene.

13. The one-piece mattress core foam encasement of claim 11, wherein the fold lines between the base and the right, left, top and bottom perimeter supports are in the form of generally V-shaped grooves having an angle of approximately 120 degrees.

14. The one piece mattress core foam encasement of claim 11, wherein the base and the right and left perimeter supports include a plurality of v-shaped grooves.

15. The one piece mattress core foam encasement of claim 11, wherein the base is connected to the right, left, top and bottom perimeter supports at connection which have a generally V-shaped configuration.

16. The one piece mattress core foam encasement of claim 11, wherein the right, left, top and bottom perimeter supports and the mattress core have substantially the same height measurement.

17. A mattress comprising a mattress core and a one piece foam encasement positioned about the mattress core:

the one piece foam encasement having a substantially rectangular base having a right side, a left side opposite and parallel to the right side, a top side and a bottom side opposite and parallel to the top side, the top and bottom sides being perpendicular to the left and right sides;

a right perimeter support connected to the right side of the base along a fold line;

a left perimeter support connected to the left side of the base along a fold line;

a top perimeter support connected to the top side of the base along a fold line;

a bottom perimeter support connected to the bottom side of the base along a fold line;

wherein the base of the one piece foam encasement is positioned proximate to a major surface of the mattress core and the right, left, top and bottom perimeter supports are positioned proximate to respective sides of the mattress core;

and upholstery which fits over the mattress core and the one piece foam encasement.

18. The mattress of claim 17 wherein the right or left perimeter support has a length dimension which is greater than a length dimension of the base, and wherein the top perimeter support or bottom perimeter support has a length dimension which is less than a width dimension of the base.

19. The mattress of claim 17 wherein the right or left perimeter support has a length dimension which is less than a length dimension of the base, and wherein the top perimeter support or bottom perimeter support has a length dimension which is greater than a width dimension of the base.

* * * * *

UNITED STATES PATENT AND TRADEMARK OFFICE

CERTIFICATE OF CORRECTION

PATENT NO. : 8,375,493 B2
APPLICATION NO. : 13/167061
DATED : February 19, 2013
INVENTOR(S) : Larry K. DeMoss et al.

It is certified that error appears in the above-identified patent and that said Letters Patent is hereby corrected as shown below:

On the title page, item [73] should read:

Assignee(s): Sealy Technology LLC, Trinity, NC (US)
Nomaco Inc, Zebulon, NC (US)

Signed and Sealed this
Twenty-third Day of April, 2013

Teresa Stanek Rea
*Acting Director of the United States Patent and Trademark Office*